United States Patent [19]

Lopez

[11] 4,403,636

[45] Sep. 13, 1983

[54] LAUNDRY BAG

[76] Inventor: Robin D. Lopez, 6954 N. Sheridan Rd., Chicago, Ill. 60626

[21] Appl. No.: 280,981

[22] Filed: Jul. 6, 1981

[51] Int. Cl.[3] ..... A45C 3/00

[52] U.S. Cl. ..... 150/1

[58] Field of Search ..... 150/1, 1.7, 52 R; 190/43

[56] References Cited

U.S. PATENT DOCUMENTS 1,841,891 1/1932 Hardy ..... 150/1.7
2,815,785 12/1957 Vail ..... 150/1
2,897,863 8/1959 Somers ..... 150/1
3,489,194 1/1970 Hoover ..... 150/1

FOREIGN PATENT DOCUMENTS 147301 7/1952 Australia ..... 150/1.7

*Primary Examiner*—Donald F. Norton
*Attorney, Agent, or Firm*—Wm. A. Snow

[57] ABSTRACT

A one-piece laundry bag of elongated, flat shape wherein the side edges are each provided with zippers so that when the zippers are not engaged, the bag will substantially lay out flat.

2 Claims, 6 Drawing Figures

LAUNDRY BAG

BACKGROUND OF THE INVENTION

When persons go to a laundromat to wash and dry their clothes, they usually take a great quantity of clothes with them, for instance, one week's clothing, towels, etc., to wash and dry. The clothes and towels, etc. are normally shoved into a closed laundry bag or a basket after drying and the clothes become very wrinkled. It is impossible to fold clothes and towels and place them in an orderly position in the laundry bag and hence they require a great deal of extra ironing. It was to overcome this defect that the present invention was conceived.

SUMMARY OF THE INVENTION

A laundry bag having a pair of side walls with zippers down both sides of said walls whereby the laundry from a clothes dryer may be folded flat and laid one on top of the other on the bottom of the laundry bag in an orderly fashion before the sides are anchored together with the closing of the zippers.

DETAILED DESCRIPTION OF THE INVENTION

The laundry bag 10 shown herein is constructed of a one-piece, flat, heavy, elongated cloth 12. The material may be cotton, synthetics or other heavy material and folded in half lengthwise.

Heavy zippers 14, 16 are anchored on both side edges of the material and extend substantially the length of the side edges.

Figure 1:
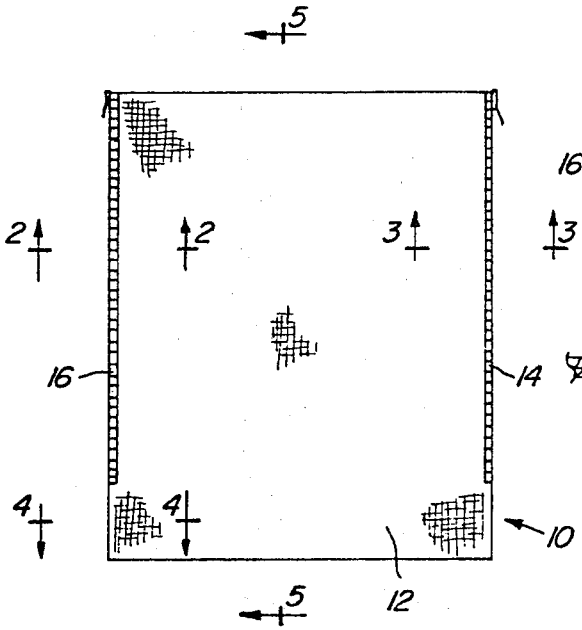
FIG. 1 is a plan view of one side of the laundry bag.
Figure 2:
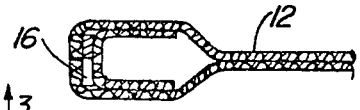
FIG. 2 is a cross-sectional view taken on the line 2—2 of FIG. 1.
Figure 3:
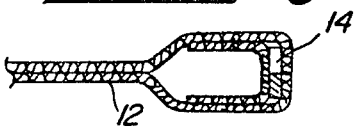
FIG. 3 is a cross-sectional view taken on the line 3—3 of FIG. 1.
Figure 4:
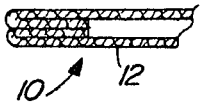
FIG. 4 is a cross-sectional view taken on the line 4—4 of FIG. 1.
Figure 6:
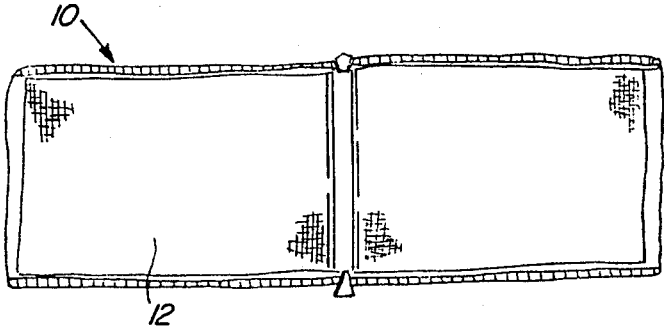
FIG. 6 is a plan view of the laundry bag in wholly open position.
Figure 5:
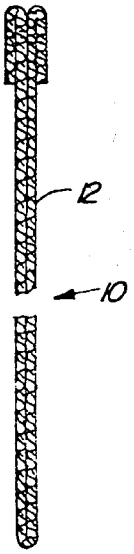
FIG. 5 is a cross-sectional view taken on the line 5—5 of FIG. 1.

When the bag is in open position, see FIG. 6, it may be laid substantially flat so that articles of laundered items may be folded and placed in an orderly fashion one on top of the other to avoid wrinkling after removal from the clothes dryer.

The side edges of the bag may be partially closed by the zippers 14, 16 as the pile of laundered items becomes higher, and completely closed when desired.

The laundered items are removed from the bag in a manner reverse from the filling thereof and they will have less or no wrinkles and this saves a lot of ironing time, therefore saving energy by using less electrical power by use of an electric iron.

The bag, after folding in half, may have the lower edges of the side walls partially sewn together before anchoring the fastening means, "zippers", to the side edges which extend to the top of the bag.

It should be apparent that any closure and opening means may be substituted for the zippers, for instance Velcro.

It is to be understood that many details may be altered or omitted without departing from the spirit of this invention.

I claim:

1. A laundry bag comprising an elongated, flat heavy, fabric material folded in half upon itself, the lower portion of the side edges partially sewn together, means on both side edges above the portion sewn together and extending to the top of the bag for opening and closing said side edges whereby the bag may be substantially laid flat.

2. The device according to claim 1 wherein said means are zippers.

* * * * *